US011249430B2

(12) United States Patent
Sakurai

(10) Patent No.: US 11,249,430 B2
(45) Date of Patent: Feb. 15, 2022

(54) IMAGE FORMING APPARATUS

(71) Applicant: OKI ELECTRIC INDUSTRY CO., LTD., Tokyo (JP)

(72) Inventor: Motoharu Sakurai, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 24 days.

(21) Appl. No.: 16/793,485

(22) Filed: Feb. 18, 2020

(65) Prior Publication Data

US 2020/0310317 A1 Oct. 1, 2020

(30) Foreign Application Priority Data

Mar. 27, 2019 (JP) ..... JP2019-061056

(51) Int. Cl.
*G03G 15/00* (2006.01)

(52) U.S. Cl.
CPC ..... *G03G 15/5062* (2013.01); *G03G 15/6552* (2013.01); *B65H 2408/13* (2013.01)

(58) Field of Classification Search
CPC ..... B65H 2408/13; G07B 1/00
See application file for complete search history.

(56) References Cited

U.S. PATENT DOCUMENTS 4,726,697 A * 2/1988 Maedge ..... B41J 11/70 400/625
5,588,762 A * 12/1996 Suzuki ..... B41J 15/005 400/582
2010/0327509 A1* 12/2010 McGarry ..... B65H 29/12 270/18
2017/0336739 A1 11/2017 Okabe et al.

FOREIGN PATENT DOCUMENTS

JP 2005-001139 A 1/2005

* cited by examiner

*Primary Examiner* — Jennifer Bahls
(74) *Attorney, Agent, or Firm* — Panitch Schwarze Belisario & Nadel LLP

(57) ABSTRACT

An image forming apparatus includes an image forming section, a discharging section, and a controller. The image forming section performs printing of an image on a medium on the basis of received print data. The discharging section executes discharging operation and holding operation. The discharging operation is operation of discharging the medium subjected to the printing by the image forming section from a discharging slot to an outside. The holding operation is operation of holding the medium while exposing a portion of the medium from the discharging slot to the outside. The controller selects one of the discharging operation and the holding operation on the basis of attribute information included in the print data, and causes the discharging section to execute the selected one of the discharging operation and the holding operation.

10 Claims, 3 Drawing Sheets

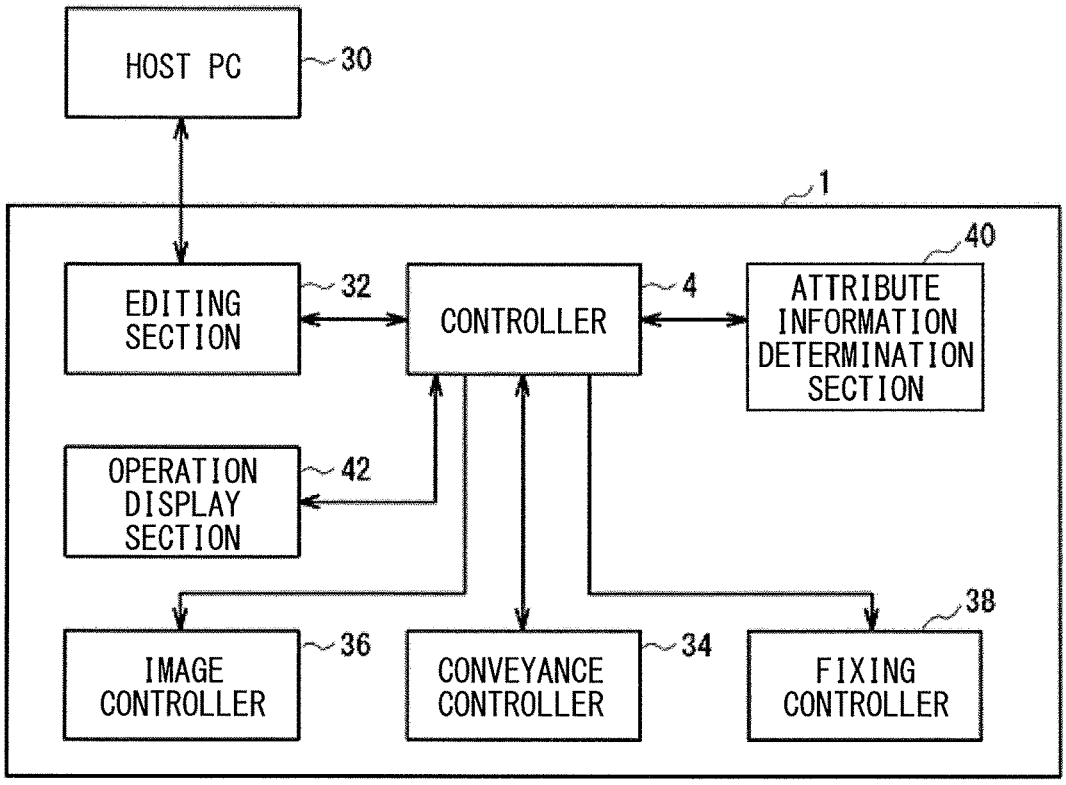
FIG. 3
| ATTRIBUTE ITEM | ATTRIBUTE INFORMATION VALUE |
|---|---|
| PAGE | FIRST PAGE, SECOND PAGE, THIRD PAGE |
| JOB | FIRST JOB, SECOND JOB, THIRD JOB |
| USER | USER A, USER B, USER C |
FIG. 4
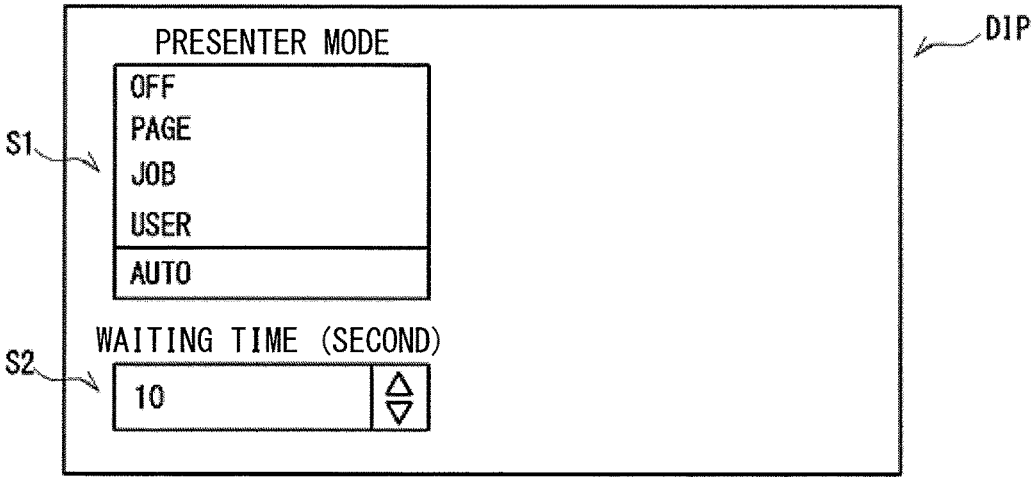
FIG. 5

IMAGE FORMING APPARATUS

CROSS REFERENCE TO RELATED APPLICATIONS

The present application claims priority from Japanese Patent Application No. 2019-061056 filed on Mar. 27, 2019, the entire contents of which are hereby incorporated by reference.

BACKGROUND

The technology relates to an image forming apparatus. For example, the technology may be suitably applied to an image forming apparatus such as an electrophotographic printer or an el electrophotographic copying machine.

There have been image forming apparatuses that perform printing of pieces of print data corresponding to respective pages on long sheet material page by page, cut the long sheet material into pages, and discharge sheets of the paper from a discharging slot to an outside (for example, see Japanese Unexamined Patent Application Publication No. 2005-001139). Such image forming apparatuses may include an image forming apparatus that holds the sheet material for each piece of print data corresponding to one page while exposing a portion of the sheet material from the discharging slot to the outside. When a user pulls out the piece of sheet material, the image forming apparatus holds the sheet material for a piece of print data corresponding to another page while exposing a portion of the sheet material from the discharging slot to the outside.

SUMMARY

In a case of an image forming apparatus that holds a sheet material for each piece of print data corresponding to one page while exposing a portion of the sheet material from a discharging slot to an outside, and when a user pulls out the piece of sheet material, holds the sheet material for a piece of print data corresponding to another page while exposing a portion of the sheet material from the discharging slot to the outside, however, a user typically has to pull out pieces of the sheet material page by page.

It is desirable to provide an image forming apparatus that makes it possible to improve usability.

According to one embodiment of the technology, there is provided an image forming apparatus that includes an image forming section, a discharging section, and a controller. The image forming section performs printing of an image on a medium on the basis of received print data. The discharging section executes discharging operation and holding operation. The discharging operation is operation of discharging the medium subjected to the printing by the image forming section from a discharging slot to an outside. The holding operation is operation of holding the medium while exposing a portion of the medium from the discharging slot to the outside. The controller selects one of the discharging operation and the holding operation on the basis of attribute information included in the print data, and causes the discharging section to execute the selected one of the discharging operation and the holding operation.

According to one embodiment of the present technology, there is provided an image forming apparatus that includes an image forming section, a discharging section, and a controller. The image forming section performs printing of an image on a medium on the basis of received print page data. The discharging section executes discharging operation and holding operation. The discharging operation is operation of discharging the medium subjected to the printing by the image forming section from a discharging slot to an outside. The holding operation is operation of holding the medium while exposing a portion of the medium from the discharging slot to the outside. The controller selects one of the discharging operation and the holding operation on the basis of attribute information included in the print page data, and causes the discharging section to execute the selected one of the discharging operation and the holding operation. The controller causes the discharging section to execute the holding operation of the medium subjected to printing based on a piece of the print page data in a case where a value of the attribute information has changed between pages in the print page data. The piece of the print page data corresponding to a page with a changed value of the attribute information.

As described above, according to an embodiment of the technology, the discharging operation is repeatedly executed in a case where the attribute information has not changed. In a case where the attribute information has changed, the holding operation is executed until the medium is pulled out. This makes it possible to omit operation of pulling out the medium performed by the user in the case where the attribute information has not changed.

BRIEF DESCRIPTION OF THE DRAWINGS

FIG. 3 is a block diagram illustrating an example of a control configuration of the image forming apparatus.

FIG. 4 is a diagram illustrating an example of attribute information.

FIG. 5 is a diagram illustrating an example of a presenter mode attribute information selection screen.

DETAILED DESCRIPTION

Figure 1:
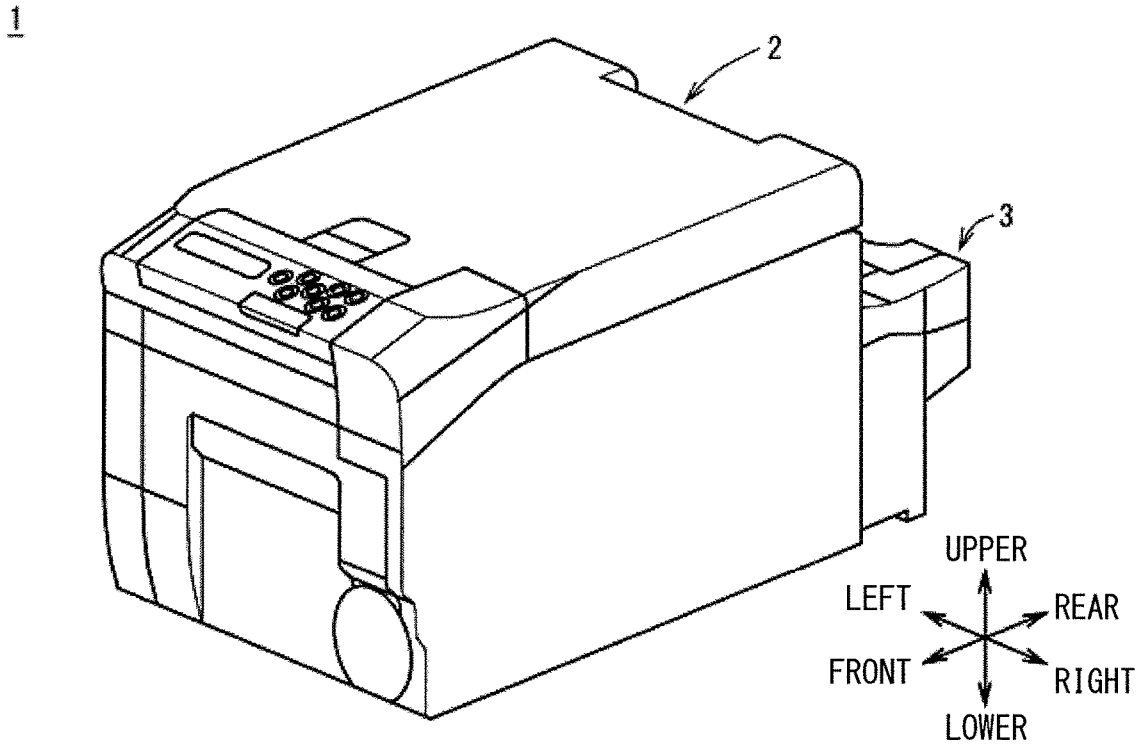
FIG. 1 is a perspective view of an example of an external configuration of an image forming apparatus according to an example embodiment of the technology.

Hereinafter, some example embodiments of the technology (hereinafter, referred to simply as example embodiments) are described with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. Overall Configuration of Image Forming Apparatus

Figure 2:
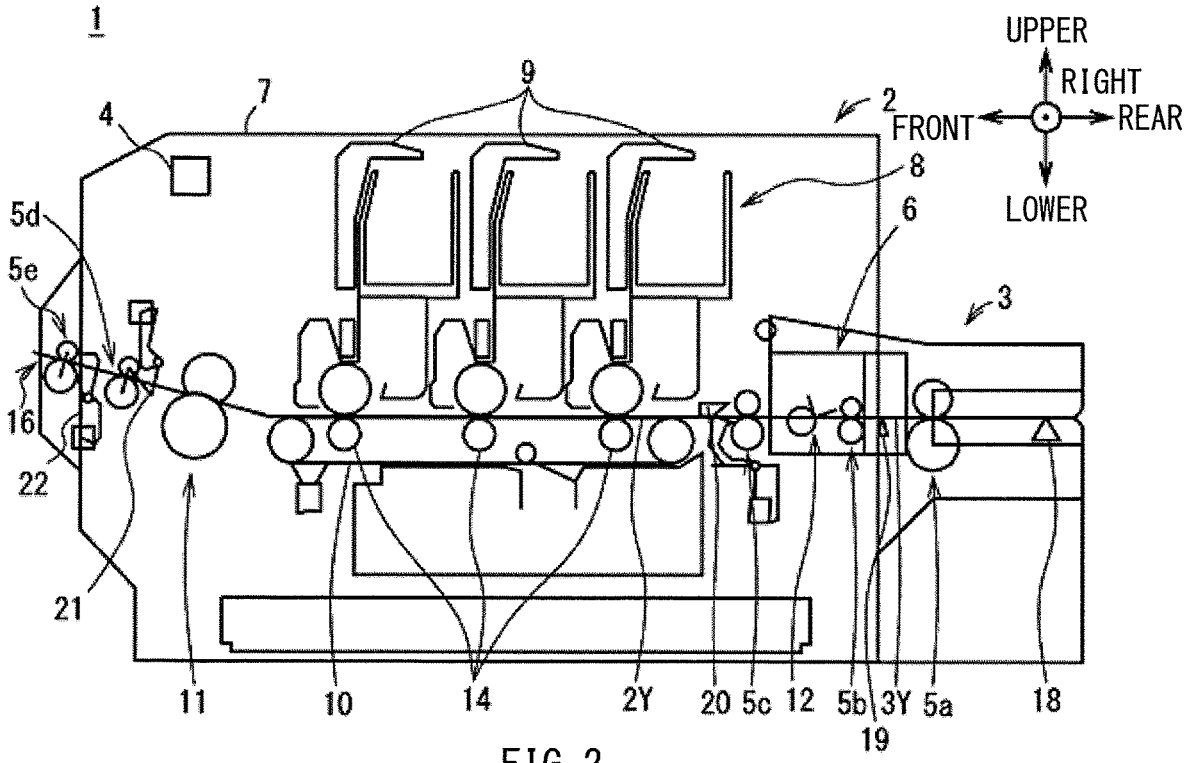
FIG. 2 is a right side view of an example of an internal configuration of the image forming apparatus.

As illustrated in FIG. 1 and FIG. 2, an image forming apparatus 1 according to an example embodiment of the technology may be an electrophotographic printer, for example. For example, the image forming apparatus 1 may print a desired image on a medium. Non-limiting examples of the image may include a color image. Non-limiting examples of the medium may include a sheet of paper with a long length. A controller 4 may exert overall control on the whole image forming apparatus 1. The controller 4 may mainly include an unillustrated central processing unit (CPU). The controller 4 may control respective sections and units and perform various kinds of processes by reading out a predetermined program from an unillustrated storage device and executing the program. The storage may include, for example, a read-only memory (ROM), a random-access memory (RAM), a flash memory, or any other suitable memory. The image forming apparatus 1 may mainly include a body section 2, a conveying-cutting section 3, and an unillustrated roll feeding section. The body section 2 may perform a print process. The conveying-cutting section 3 may be provided on rear side of the body section 2. The conveying-cutting section 3 may convey and cut paper. The roll feeding section may be provided on the rear side of the conveying-cutting section 3. The roll feeding section may feed the paper. For convenience of description, hereinafter, while the body section 2 side is defined as front side, the conveying-cutting section 3 side is defined as rear side, side nearer to a viewer of a paper plane of FIG. 2 is defined as a right side, side farther from the viewer of the paper plane of FIG. 2 is defined as left side, and an upper side and a lower side are defined as illustrated. The paper may be wound around an unillustrated core extending in a right-left direction in a manner that the paper circles around a circumferential side surface of the core and thereby form a roll. At a time of printing, one end of the roll may be peeled off from its outermost circumference and the paper may travel along a conveyance path which will be described later.

The conveying-cutting section 3 may be provided with a conveyance path 3Y extending in a front-rear direction. In addition, the conveying-cutting section 3 may include a pair of medium feeding rollers 5*a* and a medium cutting section 6 that are disposed along the conveyance path 3Y in order from the rear side toward the front side. The pair of medium feeding rollers 5*a* may include two rollers disposed in a manner that an upper roller and a lower roller sandwich the conveyance path 3Y. The pair of medium feeding rollers 5*a* may cause the paper to travel in a conveyance direction by appropriately rotating the rollers. The conveyance direction may be a direction toward the front.

The medium cutting section 6 may be a rotary cutter section that cuts the paper by using a cutter 12 while conveying the paper. The medium cutting section 6 may include members such as a pair of built-in registration rollers 5*b*. The cutter 12 may include a stationary blade that is fixed and a rotary blade that rotates. The pair of registration rollers 5*b* may convey the paper. The medium cutting section 6 may cut the paper into sheets having a predetermined sheet length along the conveyance direction, convey the sheets of paper along the conveyance path 3Y by using the pair of registration rollers 5*b*, cause the sheets of paper to travel into the body section 2 on the front side, and pass the sheets of paper to a pair of conveying rollers 5*c*.

The body section 2 may be provided with a conveyance path 2Y extending in the front-rear direction. The pair of conveying rollers 5*c* may include two rollers disposed in a manner that an upper roller and a lower roller sandwich the conveyance path 2Y. The pair of conveying rollers 5*c* may convey the sheets of paper to the front side along the conveyance path 2Y by appropriately rotating the rollers. The body section 2 may include an image forming section 8 on upper side in a body housing 7. The body housing 7 may have a cuboid shape, for example. The image forming section 8 may include three image forming units 9 arranged in the front-rear direction. Each of the image forming units 9 may form a toner image in a predetermined color under the control of the controller 4, and transfer the toner image onto a sheet of paper conveyed by a conveyance belt 10. The conveyance belt 10 may lie on a plurality of belt rollers while being stretched. The conveyance belt 10 may travel, thereby conveying the sheet f paper to the front side along the conveyance path 2Y and causing the sheet of paper to reach a fixing section 11.

The fixing section 11 may heat and rotate fixing rollers disposed on lower side and upper side of the conveyance path 2Y, apply heat and pressure to the sheet of paper to fix the toner images to the sheet of paper, and pass the sheet of paper to a pair of discharging rollers 5*d*. The pair of discharging rollers 5*d* may include two rollers disposed in a manner that an upper roller and a lower roller sandwich the conveyance path 2Y. The pair of discharging rollers 5*d* may convey the sheet of paper to the front side along the conveyance path 2Y by appropriately rotating the rollers, and discharge the sheet of paper from a discharging slot 16 to the outside.

A pair of sandwiching rollers 5*e* may be disposed slightly on the rear side of the discharging slot 16. The pair of sandwiching rollers 5*e* may include two rollers disposed in a manner that an upper roller and a lower roller sandwich the conveyance path 2Y. Under the control of the controller 4, the upper roller and the lower roller may sandwich an upstream end of the sheet of paper in a manner that a downstream end of the sheet of paper is exposed from the discharging slot 16 to the front side. The upstream end may be an end of the sheet of paper on the upstream side in the conveyance direction. The downstream end may be an end of the sheet of paper on the downstream side in the conveyance direction. The pair of sandwiching rollers 5*e* may so hold the sheet of paper as to prevent the sheet of paper from falling down from the discharging slot 16, while exposing a front portion of the sheet of paper from the discharging slot 16 to the outside.

The image forming apparatus 1 may further include therein a medium end sensor 18, a medium feed sensor 19, a writing sensor 20, a discharge sensor 21, and a pullout sensor 22. Each of the medium end sensor 18, the medium feed sensor 19, the writing sensor 20, the discharge sensor 21, and the pullout sensor 22 may be a medium detection sensor directed to recognizing passage of a sheet of paper. When the sheet of paper passes through each medium detection sensor, the medium detection sensor may automatically operate and transmit a detection result to the controller 4. The controller 4 may measure detection timings of the medium end sensor 18, the medium feed sensor 19, the writing sensor 20, the discharge sensor 21, and the pullout sensor 22, and thereby detect a paper conveyance delay, a paper jam, or any other fact to be detected.

The image forming apparatus 1 configured as described above may use the pair of medium feeding rollers 5*a* to feed a sheet of paper detected by the medium end sensor 18, cause the sheet of paper to pass through the medium feed sensor 19, and use the pair of registration rollers 5*b* and the pair of conveying rollers 5*c* to convey the sheet of paper. Thereafter, the image forming apparatus 1 may use the conveyance belt 10 to convey the sheet of paper, use the image forming units 9 and transfer rollers 14 to transfer toner images onto the sheet of paper, and use the fixing section 11 to fix the toner images to the sheet of paper. In a case where the paper is a roll of paper, the image forming apparatus 1 may use the cutter 12 to cut the paper into sheets of the paper having a predetermined size. In addition, the image forming apparatus 1 may stop the various kinds of rollers, and thereby stop conveyance of the sheet of paper that has passed through the discharge sensor 21 and has been discharged by the pair of discharging rollers 5*d* before the upstream end of the sheet of paper passes through the pullout sensor 22. The image forming apparatus 1 may sandwich the upstream end of the sheet of paper in the conveyance direction between the pair of sandwiching rollers 5*e*, and wait until a user pulls out the sheet of paper. When the pullout sensor 22 detects that the user has pulled out the sheet of paper in the above-described situation, the image forming apparatus 1 may start next printing.

2. Control Configuration of Image Forming Apparatus

As illustrated in FIG. 3, in the image forming apparatus 1, the controller 4 may be coupled to respective controllers and sections (an editing section 32, a conveyance controller 34, an image controller 36, a fixing controller 38, an attribute information determination section 40, and an operation display section 42), and may exert overall control on the whole image forming apparatus 1.

The editing section 32 may receive print data transmitted from a higher-level host such as an external host personal computer (PC), and instruct the controller 4 to perform printing. In one example, the print data may be accompanied by attribute information as illustrated in FIG. 4. Non-limiting examples of attribute items in the attribute information may include items of PAGE, JOB, and USER. The PAGE attribute may indicate pages of the print data, and may include values such as a first page, a second page, a third page, and so on as attribute information values that are values of the attribute item. The JOB attribute may indicate names of jobs including a plurality of pages with regard to the print data, and include values such as a first job, a second job, a third job, and so on as values of the attribute item. In addition, a single job may include one or a plurality of pages. The USER attribute may indicate names of users who intend to make a print with regard to a print job, and include values such as a user A, a user B, a user C, and so on as values of the attribute item. In addition, a single user may correspond to one or a plurality of jobs.

The conveyance controller 34 may control conveyance of sheets of paper by controlling members such as the various kinds of rollers. The image controller 36 may form toner images on a sheet of paper by controlling a section such as the image forming section 8. The fixing controller 38 may fix the toner images to the sheet of paper by controlling a section such as the fixing section 11. The attribute information determination section 40 may determine attribute information accompanying the print data, and decide holding operation, discharging operation, or discharge timing waiting operation. The operation display section 42 may include a display section and an operation section. The display section may include a liquid crystal display (LCD) and display various kinds of screens, for example. The operation section may include a keyboard that allows the user to perform operation such as information input operation. The operation display section 42 may correspond to an "attribute information selector" in one specific but non-limiting embodiment of the technology.

3. Print Process

Figure 6:
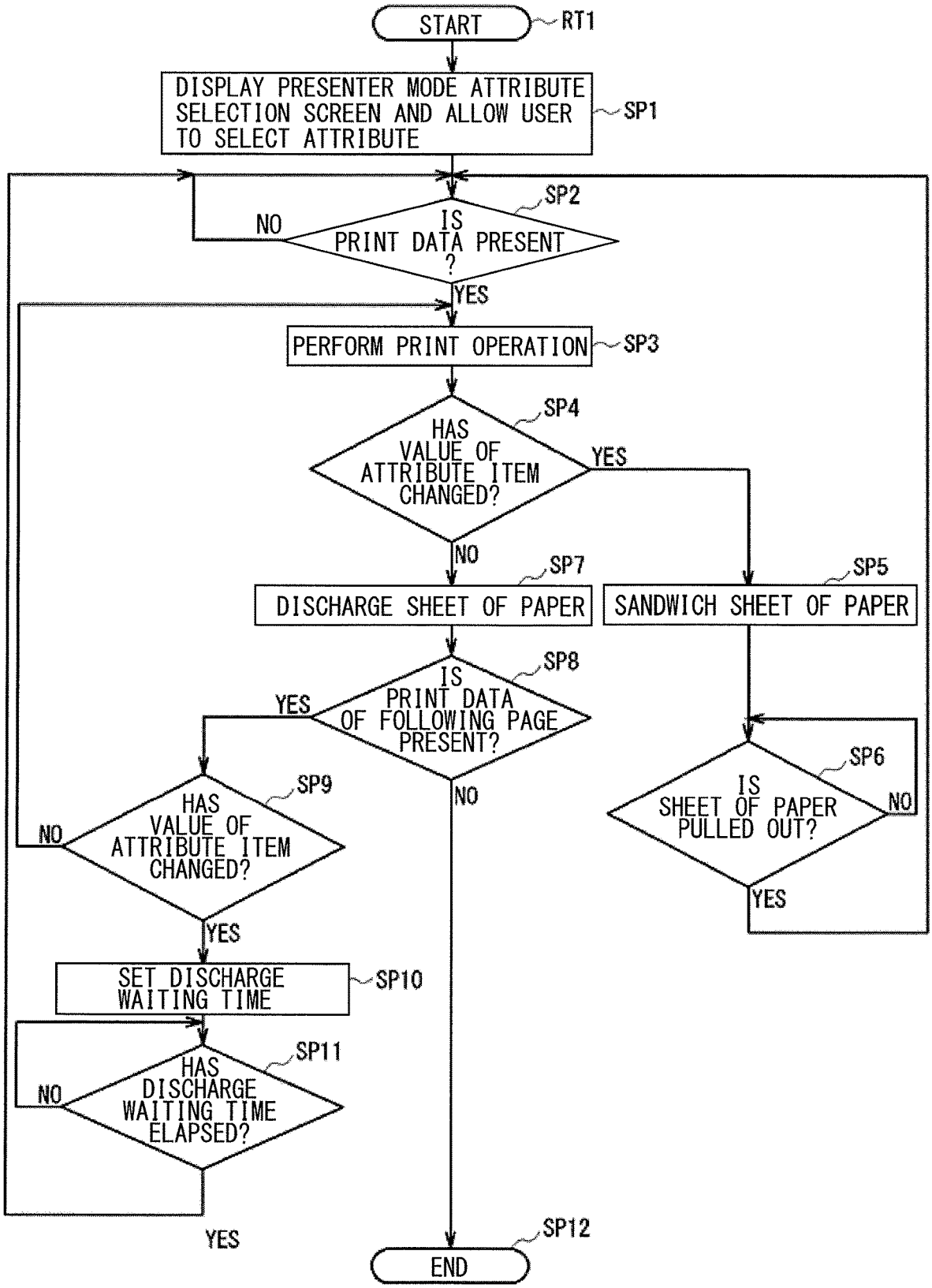
FIG. 6 is a flowchart illustrating an example of a print process procedure.

Next, with reference to a flowchart illustrated in FIG. 6, description is given of details of a specific but non-limiting example of a process procedure of the print process performed by the image forming apparatus 1. When the image forming apparatus 1 is powered on, the controller 4 may start a print process procedure RT1 and may proceed to Step SP1. Step SP1 the controller 4 may cause the operation display section 42 to display a presenter mode attribute selection screen DIP illustrated in FIG. 5. This may allow for a user to designate an attribute of a presenter mode and a discharge waiting time. Thereafter, the controller 4 may proceed to Step SP2. The presenter mode attribute selection screen DIP may include a presenter mode selecting section S1 and a discharge waiting time setting section S2. The presenter mode selecting section S1 may allow the user to select whether to turn on or off the presenter mode (the presenter mode is turned on by default), and allow the user to select an attribute in a state where the presenter mode is turned on (by default).

In one example, the presenter mode may be a mode of performing holding operation of holding a sheet of paper by the pair of sandwiching rollers 5*e* in a state where a portion of the sheet of paper is exposed from the discharging slot 16 to the outside. On the sheet of paper, printing has been performed on the basis of the print data. With regard to the presenter mode, one of five attributes including OFF, PAGE, JOB, USER, and AUTO may be selected.

If the OFF attribute is selected, the presenter mode may be disabled. The OFF attribute may be an attribute directed to performing the discharging operation without performing the holding operation. In the discharging operation, the sheet of paper on which the print data is printed may be discharged from the discharging slot 16 to the outside.

The PAGE attribute, the JOB attribute, the USER attribute, and the AUTO attribute may be attributes directed to selecting an attribute of the presenter mode in a state where the presenter mode is enabled. The PAGE attribute may be directed to performing the holding operation when a sheet of paper on which print data of a current page is printed is conveyed to the discharging slot 16 in a case where attribute information values of pages included in attribute information of the print data have changed between switched pages, in other words, in a case where an attribute information value of the current page has changed from an attribute information value of an immediately-preceding page. Therefore, in a case where the user has selected the PAGE attribute, the image forming apparatus 1 may hold a sheet of paper corresponding to a piece of print data equivalent to one page while exposing a portion of the sheet of paper from the discharging slot 16 to the outside. When the user pulls out the sheet of paper, the image forming apparatus 1 may hold a sheet of paper of one following page while exposing a portion of the sheet of paper of the following page from the discharging slot 16 to the outside.

The JOB attribute may be directed to performing the holding operation for only a first page immediately after change of the job, and thereafter performing the discharging operation until another change of the job is made. Therefore, in a case where the user has selected the JOB attribute and current print data is a different job from immediately-preceding print data, the image forming apparatus 1 may perform the holding operation when a sheet of paper on which the print data of the current job is printed is conveyed to the discharging slot 16. Thereafter, the image forming apparatus 1 may perform the discharging operation as long as current print data is the same job as immediately-preceding print data.

The USER attribute may be directed to performing the holding operation for only a first page immediately after change of the user, and thereafter performing the discharging operation until another change of the user is made. Therefore, in a case where the user has selected the USER attribute and a user of current print data is different from a user of immediately-preceding print data, the image forming apparatus 1 may perform the holding operation when a sheet of paper on which the print data of the current user is printed is conveyed to the discharging slot 16. Thereafter, the image forming apparatus 1 may perform the discharging operation as long as a user of current print data is the same as a user of immediately-preceding print data.

The AUTO attribute may be a combination of the JOB attribute and the USER attribute. The AUTO attribute may be directed to performing the holding operation of a first page immediately after change of the job, the user, or both and thereafter performing the discharging operation until another change of the job or the user is made. Therefore, in a case where the user has selected the AUTO attribute and current print data is a different job from immediately-preceding print data or a user of the current print data is different from a user of the immediately-preceding print data, the image forming apparatus 1 may perform the holding operation when a sheet of paper on which the print data of the current job and user is printed is conveyed to the discharging slot 16. Thereafter, the image forming apparatus 1 perform the discharging operation as long as a job and a user of current print data are the same as a job and a user of immediately-preceding print data.

The discharge waiting time setting section S2 may allow the user to designate a discharge waiting time when the USER attribute is selected. The discharge waiting time may refer to a time for which a sheet of paper waits to be discharged while not being exposed from the discharging slot 16 to the outside in a case where a user of current print data is different from a user of immediately-following print data.

In Step SP2, the controller 4 may wait until the editing section 32 receives print data from the higher-level host such as the host PC 30. When the editing section 32 receives the print data, the controller 4 may proceed to Step SP3. In Step SP3, the controller 4 may perform print operation of one page by using the conveyance controller 34, the image controller 36, and the fixing controller 38, and may proceed to Step SP4.

In Step SP4, the controller 4 may use the attribute information determination section 4C) to determine whether or not an attribute information value of an attribute item indicated by the attribute designated by the presenter mode selecting section S1 (FIG. 5) has changed from that of an immediately-preceding page among the attribute information accompanying the print data. If a positive result is obtained, this may indicate that, among the attribute information accompanying the print data, an attribute information value of an attribute item indicated by the designated attribute with regard to a current page has changed from that of the immediately-preceding page. In this case, the controller 4 may proceed to Step SP5.

In Step SP5, the controller 4 may cause the pair of sandwiching rollers 5*e* to sandwich an upstream end of a sheet of paper in the conveyance direction before discharging the sheet of paper on which the current page is printed. The controller 4 may thereby allow the sheet of paper to be held and prevent the sheet of paper from falling down from the discharging slot 16 in a state where the sheet of paper is exposed from the discharging slot 16 to the front side. Thereafter, the controller 4 may proceed to Step SP6. In Step SP6, the controller 4 may wait until the user pulls out the sheet of paper from the discharging slot 16. When the sheet of paper is pulled out, the controller 4 may return to Step SP2 and repeat the above-described process.

In contrast, if a negative result is obtained in Step SP4, this may indicate that, among the attribute information accompanying the print data, an attribute information value of an attribute item indicated by the designated attribute with regard to a current page has not changed from that of the immediately-preceding page. In this case, the controller 4 may proceed to Step SP7. In Step SP7, the controller 4 may discharge the sheet of paper without sandwiching the sheet of paper between the pair of sandwiching rollers 5*e*, and the controller 4 may proceed to Step SP8.

In Step SP8, the controller 4 may determine whether or not print data of a following page is present. If a positive result is obtained, this may indicate that the print data of the following page is present. In this case, the controller 4 may proceed to Step SP9.

In Step SP9, the controller 4 may use the attribute information determination section 40 to determine whether or not an attribute information value of an attribute item indicated by the attribute designated by the presenter mode selecting section S1 (FIG. 5) with regard to an immediately-following page has changed from that of a current page that has been subjected to printing and has been discharged this time, among the attribute information accompanying the print data. The immediately-following page may be a page after the current page by one page. If a positive result is obtained here, this may indicate that, among the attribute information accompanying the print data, an attribute information value of an attribute item indicated by the designated attribute with regard to the immediately-following page has changed from that of a current page. In this case, the controller 4 may proceed to Step SP10).

In contrast, if a negative result is obtained in Step SP9, this may indicate that, among the attribute information accompanying the print data, an attribute information value of an attribute item indicated by the designated attribute with regard to an immediately-following page has not changed from that of a current page. In this case, the controller 4 may return to Step SP3, and repeat the above-described process.

In Step SP10, the controller 4 may set the discharge waiting time selected by the discharge waiting time setting section S2 (FIG. 5) and thereafter start to measure time. Thereafter, the controller 4 may proceed to Step SP11. In Step SP11, the controller 4 may wait until the time corresponding to the discharge waiting time has elapsed after the measurement of the time has been started. When the discharge waiting time has elapsed, the controller 4 may return to Step SP2 and repeat the above-described process.

In contrast, if a negative result is obtained in Step SP8, this may indicate that the print data of the following page is not present. In this case, the controller 4 may proceed to Step SP12, and may end the print process procedure RT1.

4. Print Process with Regard to Respective Attributes of Presenter Mode

Hereinafter, description is given of a specific process performed in a case where each of the PAGE attribute, the JOB attribute, the USER attribute, and the AUTO attribute is selected as an attribute in the presenter mode attribute selection screen DIP (FIG. 5).

4-1. Print Process Performed in Case where PAGE Attribute is Selected

The following describes the print process procedure RT1 performed in a case where the PAGE attribute is designated in the presenter mode attribute selection screen DIP (FIG. 5). It is assumed that there are pieces of print data corresponding to three jobs, each job includes two pages, and a second page of a first job has already been printed and discharged.

After Step SP1 and Step SP2, the controller 4 may first print a first page of a second job in Step SP3. Thereafter, in Step SP 4, a value of the PAGE attribute that is an attribute item indicated by the attribute designated by the presenter mode selecting section S1 (FIG. 5) with regard to the current page (i.e., the first page of the second job) has changed from that of the immediately-preceding page (i.e., the second page of the first job), among the attribute information accompanying the print data. In other words, the value of the PAGE attribute has changed from the second page to the first page between the immediately-preceding page and the current page. Therefore, the controller 4 may obtain a positive result and proceed to Step SP5.

In Step SP5, the controller 4 may cause the pair of sandwiching rollers 5*e* to sandwich an upstream end of a sheet of paper in the conveyance direction before discharging the sheet of paper on which the first page of the second job is printed. This may allow the sheet of paper to be held and prevent the sheet of paper from falling down from the discharging slot 16, in a state where the sheet of paper on which the first page of the second job is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of the second page of the second job is present. Thereafter, the controller 4 may proceed to Step SP3.

Thereafter, the controller 4 may print the second page of the second job in Step SP3. In Step SP 4, a value of the PAGE attribute that is an attribute item indicated by the designated attribute with regard to the current page (i.e., the second page of the second job) has changed from that of the immediately-preceding page (i.e., the first page of the second job). Accordingly, the controller 4 may obtain a positive result, and proceed to Step SP5.

In Step SP5, the controller 4 may cause the pair of sandwiching rollers 5*e* to sandwich an upstream end of a sheet of paper in the conveyance direction before discharging the sheet of paper on which the second page of the second job is printed. This may allow the sheet of paper to be held and prevent the sheet of paper from falling down from the discharging slot 16, in a state where the sheet of paper on which the second page of the second job is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of a first page of a third job is present. Thereafter, the controller 4 may proceed to Step SP3.

Thereafter, the controller 4 may print the first page of the third job in Step SP3. In Step SP4, the controller 4 may obtain a positive result because a value of the PAGE attribute that is an attribute item indicated by the designated attribute with regard to the current page (i.e., the first page of the third job) has changed from that of the immediately-preceding page (i.e., the second page of the second job). Thereafter, the controller 4 may proceed to Step SP5.

In Step SP5, the controller 4 may cause the pair of sandwiching rollers 5*e* to sandwich an upstream end of a sheet of paper in the conveyance direction before discharging the sheet of paper on which the first page of the third job is printed. This may allow the sheet of paper to be held and prevent the sheet of paper from falling down from the discharging slot 16, in a state where the sheet of paper on which the first page of the third job is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of a second page of the third job is present. Thereafter, the controller 4 may proceed to Step SP3. Thereafter, the controller 4 may perform, on the third job, a process similar to the above-described process performed when the second page is to be printed.

As described above, in a case where the PAGE attribute is selected as an attribute of the presenter mode, the controller 4 may perform the holding operation each time the page changes, and wait until the user pulls out sheets of paper in a way similar to existing techniques.

4-2. Print Process Performed in Case where JOB Attribute is Selected

Next, the following describes the print process procedure RT1 performed in a case where the JOB attribute is designated in the presenter mode attribute selection screen DIP (FIG. 5). It is assumed that there are pieces of print data corresponding to three jobs, each job includes two pages, and the second page of the first job has already been printed and discharged.

After Step SP1 and Step SP2, the controller 4 may print the first page of the second job in Step SP3. In Step SP 4, the controller 4 may obtain a positive result because a value of the JOB attribute that is an attribute item indicated by the attribute designated by the presenter mode selecting section S1 (FIG. 5) with regard to a current page (the first page of the second job) has changed from that of the immediately-preceding page (the second page of the first job), among the attribute information accompanying the print data. In other words, the value of the JOB attribute has changed from the first job to the second job between the immediately-preceding page and the current page. Thereafter, the controller 4 may proceed to Step SP8.

In Step S5, the controller 4 may cause the pair of sandwiching rollers 5*e* to sandwich an upstream end of a sheet of paper in the conveyance direction before discharging the sheet of paper on which the first page of the second job is printed. This may allow the sheet of paper to be held and prevent the sheet of paper from falling down from the discharging slot 16, in a state where the sheet of paper on which the first page of the second job is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of the second page of the second job is present. Thereafter, the controller 4 may proceed to Step SP3.

Thereafter, the controller 4 may print the second page of the second job in Step SP3. In Step SP4, the controller 4 may obtain a negative result because a value of the JOB attribute that is an attribute item indicated by the designated attribute with regard to a current page (the second page of the second job) has not changed from that of an immediately-preceding page (the first page of the second job). Thereafter, the controller 4 may proceed to Step SP7. In Step SP7, the controller 4 may discharge the sheet of paper without sandwiching the sheet of paper between the pair of sandwiching rollers 5*e*. On the sheet of paper, the second page of the second job, which is the current page, is printed. Subsequently, the controller 4 may proceed to Step SP8.

In Step SP8, the controller 4 may obtain a positive result because print data of an immediately-following page (the first page of the third job) after a current page (the second page of the second job) is present. Thereafter, the controller 4 may proceed to Step SP9. In Step SP9, the controller 4 may obtain a positive result because a value of the JOB attribute that is an attribute item indicated by the designated attribute with regard to the immediately-following page (the first page of the third job) has changed from that of the current page (the second page of the second job). In other words, the value of the JOB attribute has changed from the second job to the third job between the current page and the immediately-following page. Thereafter, the controller 4 may proceed to Step SP10.

In a case where an attribute of the presenter mode is the PAGE attribute, the controller 4 may set the discharge waiting time to zero second in Step SP10, and may proceed to Step SP11. In Step SP11, the controller 4 may not wait because the discharge waiting time is zero second. The controller 4 may therefore return to Step SP2 without waiting. In Step SP2, the controller 4 may obtain a positive result because print data of the first page of the third job is present. Thereafter, the controller 4 may proceed to Step SP3. Thereafter, the controller 4 may perform, on the third job, a process similar to the above-described process performed when the second job is to be printed.

As described above, in a case where the JOB attribute is selected as an attribute of the presenter mode, the controller 4 may perform the holding operation each time the JOB changes, and wait until the user pulls out sheets of paper; however, even when the page changes in one job, the controller 4 may discharge a sheet of paper without waiting until the user pulls out the sheet of paper.

4-3. Print Process Performed in Case where USER Attribute is Selected

Next, the following describes the print process procedure RT1 performed in a case where the USER attribute is designated in the presenter mode attribute selection screen DIP (FIG. 5). It is assumed that there are pieces of print data corresponding to two users who are a user A and a user B, each piece of print data of each user includes two jobs, each job includes two pages, and a second page of a first job of the user A has already been printed and discharged.

After Step SP1 and Step SP2, the controller 4 may print the first page of the second job of the user A in Step SP3. In Step SP4, the controller 4 may obtain a negative result because a value of the USER attribute that is an attribute item indicated by the attribute designated by the presenter mode selecting section S1 (FIG. 5) with regard to a current page (a first page of a second job of the user A) has not changed from that of an immediately-preceding page (the second page of the first job of the user A), among the attribute information accompanying the print data. Thereafter, the controller 4 may proceed to Step SP7. In Step SP7, the controller 4 may discharge a sheet of paper without sandwiching the sheet of paper between the pair of sandwiching rollers 5*e*. On the sheet of paper, the first page of the second job of the user A, which is the current page, is printed. Thereafter, the controller 4 may proceed to Step SP8.

In Step SP8, the controller 4 may obtain a positive result because print data of an immediately-following page (a second page of the second job of the user A) after the current page (the first page of the second job of the user A) is present. Thereafter, the controller 4 may proceed to Step SP9. In Step SP9, the controller 4 may obtain a negative result because a value of the USER attribute that is an attribute item indicated by the designated attribute with regard to the immediately-following page (the second page of the second job of the user A) has not changed from that of the current page (the first page of the second job of the user A). Thereafter, the controller 4 may return to Step SP2, repeat the above-described process, print print data of the second page of the second job of the user A, discharge a sheet of paper, and proceed to Step SP9.

In Step SP9, the controller 4 may obtain a positive result because a value of the USER attribute that is an attribute item indicated by the designated attribute with regard to an immediately-following page (a first page of a first job of the user B) has changed from that of a current page (the second page of the second job of the user A). In other words, the value of the USER attribute has changed from the user A to the user B between the current page and the immediately-following page. Thereafter, the controller 4 may proceed to Step SP10.

In a case where an attribute of the presenter mode is the USER attribute, the controller 4 may set the discharge waiting time to 10 seconds in Step SP10, and proceed to Step SP11. In Step SP11, the controller 4 may wait until the discharge waiting time elapses. In other words, the controller 4 may wait for 10 seconds before feeding a following sheet of paper on which the print data of the user B is printed. Thereafter, the controller 4 may return to Step SP2. In Step SP2, the controller 4 may obtain a positive result because the print data of the first page of the first job of the user B is present. Thereafter, the controller 4 may proceed to Step SP3.

Thereafter, the controller 4 may print the first page of the first job of the user B in Step SP3. In Step SP4, the controller 4 may obtain a positive result because a value of the USER attribute that is an attribute item indicated by the designated attribute with regard to a current page (the first page of the first job of the user B) has changed from that of an immediately-preceding page (the second page of the second job of the user A). Thereafter, the controller 4 may proceed to Step SP5.

In Step SP8, the controller 4 may cause the pair of sandwiching rollers 5*e* to sandwich an upstream end of a sheet of paper in the conveyance direction before discharging the sheet of paper on which the first page of the first job of the user B is printed. This may allow the sheet of paper to be held and prevent the sheet of paper from falling down from the discharging slot 16 in a state where the sheet of paper on which the first page of the first job of the user B is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of a second page of the first job of the user B is present. Thereafter, the controller 4 may proceed to Step SP3. Thereafter, the controller 4 may perform, on the print data of the user B, a process similar to the above-described process performed when the print data of the user A is to be printed.

As described above, in a case where the USER attribute is selected as an attribute of the presenter mode, the controller 4 may perform the holding operation each time the user changes, wait for a discharge waiting time, feed a following sheet of paper, and wait until the user pulls out sheets of paper; however, even when the job changes with regard to the same user, the controller 4 may discharge a sheet of paper without waiting until the user pulls out the sheets of paper.

4-4. Print Process Performed in Case where AUTO Attribute is Selected

Next, the following describes the print process procedure RT1 performed in a case where the AUTO attribute is designated in the presenter mode attribute selection screen DIP (FIG. 5). In a way similar to the case where the USER attribute is selected, it is assumed that there are pieces of print data corresponding to the two users who are the user A and the user B, each piece of print data of each user includes two jobs, each job includes two pages, and the second page of the first job of the user A has already been printed and discharged.

After Step SP1 and Step SP2, the controller 4 may first print the first page of the second job of the user A in Step SP3. In Step SP4, the controller 4 may obtain a positive result because a value of the JOB attribute out of the value of JOB attribute and a value of USER attribute that are attribute items indicated by the attributes designated by the presenter mode selecting section S1 (FIG. 5) with regard to a current page (the first page of the second job of the user A) has changed from that of an immediately-preceding page (the second page of the first job of the user A), among the attribute information accompanying the print data. Thereafter, the controller 4 may proceed to Step SP5.

In Step SP5, the controller 4 may cause the pair of sandwiching rollers 5*e* to sandwich an upstream end of a sheet of paper in the conveyance direction before discharging the sheet of paper on which the first page of the second job of the user A is printed. This may allow the sheet of paper to be held and prevent the sheet of paper from falling down from the discharging slot 16, in a state where the sheet of paper on which the first page of the second job of the user A is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of the second page of the second job of the user A is present. Thereafter, the controller 4 may proceed to Step SP3.

Thereafter, the controller 4 may print the second page of the second job of the user A in Step SP3. In Step SP4, the controller 4 may obtain a negative result because the value of the JOB attribute and the USER attribute that are the attribute items indicated by the designated attribute with regard to a current page (the second page of the second job of the user A) have not changed from those of an immediately-preceding page (the first page of the second job of the user A). Thereafter, the controller 4 may proceed to Step SP7. In Step SP7, the controller 4 may discharge the sheet of paper without sandwiching the sheet of paper between the pair of sandwiching rollers 5*e*. On the sheet of paper, the second page of the second job of the user A, which is the current page, is printed. Thereafter, the controller 4 may proceed to Step SP8.

In Step SP8, the controller 4 may obtain a positive result because print data of an immediately-following page (the first page of the first job of the user B) after a current page (the second page of the second job of the user A) is present. Thereafter, the controller 4 may proceed to Step SP9. In Step SP9, the controller 4 may obtain a positive result because values of both of the JOB attribute and the USER attribute that are attribute items indicated by the designated attribute with regard to the immediately-following page (the first page of the first job of the user B) have changed from those of the current page (the second page of the second job of the user A). Thereafter, the controller 4 may proceed to Step SP10.

In a case where an attribute of the presenter mode is the AUTO attribute, the controller 4 may set the discharge waiting time to 10 seconds in Step SP10, and proceed to Step SP11 in a way similar to the case of the USER attribute. In Step SP11, the controller 4 may wait until the discharge waiting time elapses. In other words, the controller 4 may wait for 10 seconds before feeding a following sheet of paper on which the print data of the user B is printed. Thereafter, the controller 4 may return to Step SP2. In Step SP2, the controller 4 may obtain a positive result because print data of the first page of the first job of the user B is present. Thereafter, the controller 4 may proceed to Step SP3.

Thereafter, the controller 4 may print the first page of the first job of the user B in Step SP3. In Step SP4, the controller 4 may obtain a positive result because values of both of the JOB attribute and the USER attribute that are attribute items indicated by the designated attribute with regard to a current page (the first page of the first job of the user B) have changed from those of an immediately-preceding page (the second page of the second job of the user A). Thereafter, the controller 4 may proceed to Step SP5.

In Step SP5, the controller 4 may cause the pair of sandwiching rollers 5*e* to sandwich an upstream end of a sheet of paper in the conveyance direction before discharging the sheet of paper on which the first page of the first job of the user B is printed. This may allow the sheet of paper to be held and prevent the sheet of paper from falling down from the discharging slot 16, in a state where the sheet of paper on which the first page of the first job of the user B is printed is exposed from the discharging slot 16 to the front side. Thereafter, the controller 4 may proceed to Step SP6. When the sheet of paper is pulled out, the controller 4 may return to Step SP2. In Step SP2, the controller 4 may obtain a positive result because print data of the second page of the first job of the user B is present. Thereafter, the controller 4 may proceed to Step SP3. Thereafter, the controller 4 may perform, on the print data of the user B, a process similar to the above-described process performed when the print data of the user A is to be printed.

As described above, in a case where the AUTO attribute is selected as an attribute of the presenter mode, the controller 4 may wait for a discharge waiting time each time the user changes. Thereafter, the controller 4 may feed a following sheet of paper, perform the holding operation, and wait until the user pulls out sheets of paper. The controller 4 may also wait until the user pulls out the sheets of paper in a case where the job has changed but the user has not changed; however, when the page has changed in one job, the controller 4 may discharge a sheet of paper without waiting until the user pulls out the sheets of paper.

5. Example Effects, Etc.

In a case where an attribute information value of an attribute item indicated by an attribute selected in advance with regard to current print data has changed from that of immediately-preceding print data, the image forming apparatus 1 configured as described above may perform the holding operation when a sheet of paper on which the current print data is printed is conveyed to the discharging slot 16. Thereafter, the image forming apparatus 1 may repeatedly perform the discharging operation until the attribute information value changes. In other words, the image forming apparatus 1 may perform the discharging operation when the attribute information value has not changed. When the attribute information value has changed, the image forming apparatus 1 may perform the holding operation of only a first page until the sheet of paper is pulled out.

Therefore, in comparison with a case of performing the holding operation for each page without considering the attribute information as in an existing image forming apparatus, the image forming apparatus 1 may make it necessary for a user to pull out a sheet of paper only of a first page immediately after the attribute information has changed. This makes it possible to prevent the user from performing burdensome operation, and makes it possible to reduce workload. In addition, after once the user pulls out the sheet of paper, the image forming apparatus 1 may end the discharging operation at the last page having the attribute information after the change of the attribute information. Therefore, even if one job includes a plurality of pages and some pages are to be sequentially printed, it is easier for the user to understand that a set of a print job continues until the discharging operation ends.

In a case where the JOB attribute is selected as an attribute of the presenter mode, the image forming apparatus 1 may perform the holding operation of a sheet of paper on which a first page of print data of a following job is printed when discharge of sheets of paper on which print data of one job is printed ends. This allows the image forming apparatus 1 to prevent the sheet of paper on which the print data of the following job is printed from being discharged and falling down while the user is treating the sheets of paper on which the print data of the one job is printed. In addition, a situation where a sheet of paper is pulled out when the attribute information has changed may indicate a situation where the user is present in front of the image forming apparatus 1. Therefore, even if sheets of papers are sequentially discharged until the attribute information changes next time, the user can receive the sheets of paper. Accordingly, there is a low possibility that the sheets of paper fall down.

In a case where the USER attribute is selected as an attribute of the presenter mode, the image forming apparatus 1 may perform the holding operation of a sheet of paper on which a first page of print data of a following user is printed when discharge of sheets of paper on which print data of a preceding user is printed ends. This allows for the image forming apparatus 1 to prevent sheets of paper on which the print data of the following user B is printed from being discharged and falling down after the user A receives sheets of paper on which the print data of the user A is printed and the user A goes away from the image forming apparatus 1.

In addition, when discharge of sheets of paper on which print data of a preceding user is printed ends, the image forming apparatus 1 may wait for a discharge waiting time before a front end of a sheet of paper on which a first page of the print data of a following user is printed is exposed from the discharging slot 16 to the outside. This allows the image forming apparatus 1 to prevent the preceding user from unintentionally taking away the printed sheets of paper of the following user.

The image forming apparatus 1 configured as described above includes the image forming section 8, the pair of sandwiching rollers 5*e*, and the controller 4. The image forming section 8 performs printing of an image on a sheet of paper as a medium on the basis of received print data. The pair of sandwiching rollers 5*e* executes the discharging operation and the holding operation. The discharging operation is operation of discharging the sheet of paper subjected to the printing by the image forming section 8 from the discharging slot 16 to the outside. The holding operation is operation of holding the sheet of paper while exposing a portion of the sheet of paper from the discharging slot 16 to the outside. The controller 4 selects one of the discharging operation and the holding operation on the basis of the attribute information included in the print data, and causes the pair of sandwiching rollers 5*e* to execute the selected one of the discharging operation and the holding operation.

This allows the image forming apparatus 1 to repeatedly perform the discharging operation in a case where the attribute information has not changed. In addition, this allows the image forming apparatus 1 to perform the holding operation until a sheet of paper is pulled out only for a first page after change of the attribute information. This makes it possible to omit operation of pulling out a sheet of paper performed by the user in a case where the attribute information has not changed.

6. Other Example Embodiments

It is to be noted that, in the example embodiments described above, the holding operation may be performed when a value of the PAGE attribute, the JOB attribute, or the USER attribute has changed as the attribute information accompanying the print data. The technology is, however, not limited thereto. In one example embodiment, the holding operation may be performed when a value of various kinds of information distinguishing attributes of pieces of print data has changed as attribute information. Non-limiting examples of the attributes may include color, monochrome, a kind of paper, a print speed, a thickness of the paper, and resolution. Non-limiting examples of the attributes may further include a cassette in a case of using cut sheets of paper.

In addition, in the above-described embodiment, one embodiment of the technology may be applied to the image forming apparatus 1 that performs printing on a roll of paper. The technology is, however, not limited thereto. One example embodiment of the technology may be applied to an image forming apparatus that performs printing on cut sheets of paper that have been cut.

In addition, in the above-described embodiment, the medium cutting section 6 may be disposed on the upstream side of the image forming section 8 in the conveyance direction. The technology is, however, not limited thereto. In one example embodiment, the medium cutting section 6 may be disposed on the downstream side of the image forming section 8 in the conveyance direction.

In addition, in the above-described embodiment, one embodiment of the technology is applied to the image forming apparatus 1 that uses a direct transfer method. The technology is, however, not limited thereto. One example embodiment of the technology may be applied to printers that use various kinds of methods such as an intermediate transfer method. According to the intermediate transfer method, a toner image is first transferred onto an intermediate transfer belt and then transferred onto paper, i.e., primary transfer and secondary transfer are performed.

In addition, in the above-described embodiment, one embodiment of the technology may be applied to the image forming apparatus 1 that uses the three image forming units 9. The technology is, however, not limited thereto. One example embodiment of the technology may be applied to a monochromatic image forming apparatus that uses a single process unit, or an image forming apparatus that uses any number of process units, that is, two or four or more process units.

In addition, in the above-described embodiment, one embodiment of the technology may be applied to the image forming apparatus 1 that is the electrophotographic printer. The technology is, however, not limited thereto. One example embodiment of the technology may be applied to an image forming apparatus included in a multi-function printer (MFP), a copy machine, an automatic text reader, or the like.

In addition, in the above-described embodiment, the image forming apparatus 1 may include the image forming section 8, the pair of sandwiching rollers 5*e*, and the controller 4. The image forming apparatus 1 may correspond to an "image forming apparatus" in the specific but non-limiting embodiment described above of the technology. The image forming section 8 may correspond to an "image forming section" in the specific but non-limiting embodiment described above of the technology. The pair of sandwiching rollers 5*e* may correspond to a "discharging section" in the specific but non-limiting embodiment described above of the technology. The controller 4 may correspond to a "controller" in the specific but non-limiting embodiment described above of the technology. The technology is, however, not limited thereto. In one example embodiment, the image forming apparatus may include an image forming section, a discharging section, and a controller that are configured in various ways other than the above.

One embodiment of the technology is applicable to various kinds of devices that cut a medium, such as paper, on which printing is performed and discharge the medium.

Furthermore, the technology encompasses any possible combination of some or all of the various embodiments and the modifications described herein and incorporated herein. It is possible to achieve at least the following configurations from the above-described example embodiments of the technology.

(1)

An image forming apparatus including:

an image forming section that performs printing of an image on a medium on the basis of received print data;

a discharging section that executes discharging operation and holding operation, the discharging operation being operation of discharging the medium subjected to the printing by the image forming section from a discharging slot to an outside, the holding operation being operation of holding the medium while exposing a portion of the medium from the discharging slot to the outside, and a controller that selects one of the discharging operation and the holding operation on the basis of attribute information included in the print data, and causes the discharging section to execute the selected one of the discharging operation and the holding operation.

(2)

The image forming apparatus according to claim 1, further including an attribute information selecting section that is allowed to select the attribute information in advance, in which the controller causes the discharging section to execute the holding operation in a case where a value of the attribute information selected by the attribute information selecting section has changed with regard to the print data among the attribute information included in the print data.

(3)

The image forming apparatus according to claim 2, in which the controller causes the discharging section to execute the discharging operation in a case where a value of the attribute information selected by the attribute information selecting section has not changed with regard to the print data among the attribute information included in the print data.

(4)

The image forming apparatus according to claim 1, in which, in a case where a value of the attribute information of current print data has changed from a value of the attribute information of immediately-preceding print data, the controller causes the discharging section to execute the holding operation when the medium subjected to printing based on the current print data is conveyed to the discharging slot, and the controller thereafter causes the discharging section to execute the discharging operation until a value of the attribute information of current print data changes from a value of the attribute information of an immediately-preceding print data, the immediately-preceding print data being the print data received immediately after the current print data.

(5)

The image forming apparatus according to claim 1, in which the controller acquires job information of the print data, the job information indicating a job, and in a case where a job of current print data is different from a job of immediately-preceding print data, the controller causes the discharging section to perform the holding operation when the medium subjected to printing based on the current print data is conveyed to the discharging slot, the immediately-preceding print data being the print data received immediately after the current print data.

(6)

The image forming apparatus according to claim 5, in which, in a case where a job of current print data is different from a job of immediately-preceding print data, the controller causes the discharging section to execute the holding operation when the medium subjected to printing based on the current print data is conveyed to the discharging slot, and the controller thereafter causes the discharging section to execute the discharging operation as long as a job of current print data is same as a job of immediately-preceding print data.

(7)

The image forming apparatus according to claim 1, in which the controller acquires user information of the print data, the user information indicating a user, and in a case where a user of current print data is different from a user of immediately-preceding print data, the controller causes the discharging section to execute the holding operation when the medium subjected to printing based on the current print data is conveyed to the discharging slot, the immediately-preceding print data being the print data received immediately after the current print data.

(8)

The image forming apparatus according to claim 7, in which, in a case where a user of current print data is different from a user of immediately-preceding print data, the controller causes the discharging section to execute the holding operation when the medium subjected to printing based on the current print data is conveyed to the discharging slot, and the controller thereafter causes the discharging section to execute the discharging operation as long as a user of current print data is same as a user of immediately-preceding print data.

(9)

The image forming apparatus according to claim 1, in which the controller acquires user information of the print data, the user information indicating a user, and in a case where a user of current print data is different from a user of immediately-following print data, the controller keeps the medium waiting in the discharging slot in a state where the medium is not exposed to the outside from the discharging slot for a predetermined period of time, the immediately-preceding print data being the print data received immediately after the current print data.

(10)

An image forming apparatus including:

an image forming section that performs printing of an image on a medium on the basis of received print page data;

a discharging section that executes discharging operation and holding operation, the discharging operation being operation of discharging the medium subjected to the printing by the image forming section from a discharging slot to an outside, the holding operation being operation of holding the medium while exposing a portion of the medium from the discharging slot to the outside; and a controller that selects one of the discharging operation and the holding operation on the basis of attribute information included in the print page data, and causes the discharging section to execute the selected one of the discharging operation and the holding operation, the controller causing the discharging section to execute the holding operation of the medium subjected to printing based on a piece of the print page data in a case where a value of the attribute information has changed between pages in the print page data, the piece of the print page data corresponding to a page with a changed value of the attribute information.

According to an embodiment of the technology, it is possible to provide an image forming apparatus that makes it possible to improve usability.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

an image forming section that performs printing of a first image on a first medium on a basis of received first print data, and thereafter performs printing of a second image on a second medium on a basis of received second print data;

a discharging section that executes a first holding operation, a first discharging operation, a second holding operation, and a second discharging operation, the first holding operation being operation of exposing a portion of the first medium from the discharging slot to an outside and holding the first medium in such a manner as to allow the first medium to be pulled out from the discharging slot to the outside, the first discharging operation being operation of discharging the first medium from the discharging slot to the outside, the second holding operation being operation of exposing a portion of the second medium subjected to the printing of the second image by the image forming section from the discharging slot to the outside and holding the second medium in such a manner as to allow the second medium to be pulled out from the discharging slot to the outside, the second discharging operation being operation of discharging the second medium from the discharging slot to the outside; and a controller that causes the discharging section to execute the second discharging operation, in a case where attribute information included in the second print data coincides with attribute information included in the first print data.

2. The image forming apparatus according to claim 1, further comprising an attribute information selecting section that allows a user to to select the attribute information included in the first print data and the attribute information included in the second print data, wherein the controller causes the discharging section to execute the second holding operation when the second medium is conveyed to the discharge slot in a case where the attribute information included in the first print data and the attribute information included in the second print data are different from each other.

3. The image forming apparatus according to claim 1, wherein, in a case where the attribute information included in the first print data and the attribute information included in the second print data are different from each other, the controller causes the discharging section to execute the second holding operation when the second medium subjected to printing based on the second print data is conveyed to the discharging slot, and the controller thereafter causes the discharging section to execute a third discharging operation only when attribute information included in third print data received after the second print data coincides with the attribute information included in the second print data, the third discharging operation being operation of discharging, from the discharging slot to the outside, a third medium subjected to printing of a third image on a basis of the third print data.

4. The image forming apparatus according to claim 1, wherein the controller acquires job information of the first print data and job information of the second print data, and in a case where the job information of the first print data and the job information of the second print data are different from each other, the controller causes the discharging section to perform the second holding operation when the second medium is conveyed to the discharging slot.

5. The image forming apparatus according to claim 4, wherein, in a case where the job information of the first print data and the job information of the second print data are different from each other, the controller causes the discharging section to execute the second holding operation when the second medium subjected to printing based on the second print data is conveyed to the discharging slot, and the controller thereafter causes the discharging section to execute a third discharging operation only when job information included in third print data received after the second print data coincides with the job information included in the second print data, the third discharging operation being operation of discharging, from the discharging slot to the outside, a third medium subjected to printing of a third image on a basis of the third print data.

6. The image forming apparatus according to claim 1, wherein the controller acquires user information of the first print data and user of the second print data, and in a case where the user information of the first print data and the user information of the second print data are different from each other, the controller causes the discharging section to execute the second holding operation when the second medium is conveyed to the discharging slot.

7. The image forming apparatus according to claim 6, wherein, in a case where the user information of the first print data and the user information of the second print data are different from each other, the controller causes the discharging section to execute the second holding operation when the second medium subjected to printing based on the second print data is conveyed to the discharging slot, and the controller thereafter causes the discharging section to execute a third discharging operation as long as a user of current print data is same as a user of immediately-preceding print data only when user information included in third print data received after the second print data coincides with the user information included in the second print data, the third discharging operation being operation of discharging, from the discharging slot to the outside, a third medium subjected to printing of a third image on a basis of the third print data.

8. The image forming apparatus according to claim 1, wherein the controller acquires user information of the first print data and user information of the second print data, and in a case where the user information of the first print data and the user information of the second print data are different from each other, the controller keeps the second medium waiting in the discharging slot in a state where the second medium is not exposed to the outside from the discharging slot for a predetermined period of time.

9. The image forming apparatus according to claim 1, wherein the controller causes the discharging section to execute the second holding operation, in a case where the attribute information included in the second print data is different from the attribute information included in the first print data.

10. The image forming apparatus according to claim 1, wherein the controller causes the discharging section to execute the second discharging operation after the first holding operation, in a case where the attribute information included in the second print data coincides with the attribute information included in the first print data.

* * * * *